United States Patent [19]

Forage et al.

[11] Patent Number: 4,832,968

[45] Date of Patent: May 23, 1989

[54] BEVERAGE PACKAGE AND A METHOD OF PACKAGING A BEVERAGE CONTAINING GAS IN SOLUTION

[75] Inventors: Alan J. Forage, Seer Green, Great Britain; William J. Byrne, Mount Merrion, Ireland

[73] Assignee: Arthur Guinness Son & Company Limited, Dublin, Ireland

[21] Appl. No.: 916,656

[22] Filed: Oct. 8, 1986

[30] Foreign Application Priority Data

Nov. 29, 1985 [GB] United Kingdom ..... 8529441

[51] Int. Cl.[4] ..... B65D 85/72

[52] U.S. Cl. ..... 426/112; 426/115; 426/124; 426/131; 426/394; 426/398; 426/407; 53/79; 53/127

[58] Field of Search ..... 426/112, 115, 124, 131, 426/316, 474, 477, 394, 398; 53/79, 127

[56] References Cited

U.S. PATENT DOCUMENTS

| | | | |
|---|---|---|---|
| 3,085,714 | 4/1963 | Lighter . | |
| 3,513,886 | 5/1970 | Easter et al. | 426/115 |
| 4,147,808 | 4/1979 | Liepa et al. | 426/477 |
| 4,186,215 | 1/1980 | Buchel | 426/477 X |
| 4,399,158 | 8/1983 | Bardsley et al. | 426/124 X |
| 4,518,082 | 5/1985 | Ye | 426/124 X |
| 4,693,902 | 9/1987 | Richmond et al. | 426/521 |

FOREIGN PATENT DOCUMENTS

| | | |
|---|---|---|
| 1266351 | 3/1972 | United Kingdom . |
| 1588624 | 4/1981 | United Kingdom . |

*Primary Examiner*—Barry S. Richman
*Assistant Examiner*—Timothy M. McMahon

[57] ABSTRACT

A beverage package and a method of packaging a beverage having gas (preferably at least one of carbon dioxide and inert (nitrogen gases) in solution has a non-resealable container 1 within which is located a hollow pod 4 having a restricted aperture 7 in a side wall. The container is charged with the beverage 8 and sealed. Beverage from the main chamber of the container enters the pod 4 (shown at 8*a*) by way of the aperture 7 to provide headspaces 1*a* in the container and 4*a* in the pod 4. Gas within the headspaces 1*a* and 4*a* is at greater than atmospheric pressure. Preferably the beverage is drawn into the hollow pod by subjecting the package to a heating and cooling cycle. Upon opening the container 1 by draw ring/region 13, the headspace 1*a* is vented to atmosphere and the pressure differential resulting from the pressure in the pod headspace 4*a* causes gas/beverage to be ejected from the pod (by way of the aperture 7) into the beverage 8. Said ejection causes gas to be evolved from solution in the beverage in the main container chamber to form a head of froth on the beverage. The pod 4 is preferably formed by blow moulding and located as a press fit within the container 1 which latter is preferably a can, carton or bottle.

35 Claims, 2 Drawing Sheets

BEVERAGE PACKAGE AND A METHOD OF PACKAGING A BEVERAGE CONTAINING GAS IN SOLUTION

TECHNICAL FIELD AND BACKGROUND ART

This invention relates to a beverage package and a method of packaging a beverage containing gas in solution. The invention more particularly concerns beverages containing gas in solution and packaged in a sealed, non-resealable, container which, when opened for dispensing or consumption, permits gas to be evolved or liberated from the beverage to form, or assist in the formation of, a head or froth on the beverage. The beverages to which the invention relates may be alcoholic or non-alcoholic; primarily the invention was developed for fermented beverages such as beer, stout, ale, lager and cider but may be applied with advantage to so-called soft drinks and beverages (for example fruit juices, squashes, colas, lemonades, milk and milk based drinks and similar type drinks) and to alcoholic drinks (for example spirits, liqueurs, wine or wine based drinks and similar).

It is recognised in the beverage dispensing and packaging art that the characteristics of the head of froth which is provided on the beverage by the liberation of gas from the beverage immediately prior to consumption are an important consideration to the consumers enjoyment of the product and are therefore of commercial importance. Conventionally beverages of the type discussed above containing gas in solution and packaged in a non-resealable container (such as a can, bottle or carton) provide a headspace in the container within which gas is maintained under pressure. Upon opening of the package, the headspace gas is vented to atmosphere and the beverage is usually poured into a drinking vessel. During such dispensing of the beverage it is usual for gas in solution to be liberated to create the froth or head. It is generally recognised that when dispensing a beverage as aforementioned, the gas is liberated as a result of the movement of the beverage over a surface having so-called gas nucleation or active sites which may be the wall of the drinking vessel into which the beverage is poured. There is therefore a distinct possibility with conventional beverage packages that upon opening of the container after storage and until the beverage is poured therefrom, the beverage will have little or no froth or head—such a headless beverage is usually regarded by the consumer as somewhat unattractive and unappealing especially where the beverage is to be drunk directly from the container. Admittedly it may be possible to develop a head or froth within the container by agitating or shaking the package (so that the movement of the beverage over the interior surface of the container causes the liberation of the gas in solution) but this is clearly inconvenient once the container is opened and is inadvisable if the package is shaken immediately prior to opening as the contents tend to spray or spurt on opening.

There is therefore a need for a beverage package and a method of packaging a beverage containing gas in solution by which the beverage is packaged in a non-resealable container so that when the container is opened gas is liberated from the beverage to form or assist in the formation of a head or froth without the necessity of an external influence being applied to the package; it is an object of the present invention to satisfy this need in a simple, economic and commercially viable manner.

STATEMENTS OF INVENTION AND ADVANTAGES

According to the present invention there is provided a beverage package comprising a sealed, non-resealable, container having a primary chamber containing beverage having gas in solution therewith and forming a primary headspace comprising gas at a pressure greater than atmospheric; a secondary chamber having a volume less than said primary chamber and which communicates with the beverage in said primary chamber through a restricted orifice, said secondary chamber containing beverage derived from the primary chamber and having a secondary headspace therein comprising gas at a pressure greater than atmospheric so that the pressures within the primary and secondary chambers are substantially at equilibrium, and wherein said package is openable, to open the primary headspace to atmospheric pressure and the secondary chamber is arranged so that on said opening the pressure differential caused by the decrease in pressure at the primary headspace causes at least one of the beverage and gas in the secondary chamber to be ejected by way of the restricted orifice into the beverage of the primary chamber and said ejection causes gas in the solution to be evolved and form, or assist in the formation of, a head of froth on the beverage.

Further according to the present invention there is provided a method of packaging a beverage having gas in solution therewith which comprises providing a container with a primary chamber and a secondary chamber of which the volume of the secondary chamber is less than that of the primary chamber and with a restricted orifice through which the secondary chamber communicates with the primary chamber, and charging and sealing the primary chamber with the beverage to contain the gas in solution and to form a primary headspace in the primary chamber, and charging the secondary chamber with beverage derived from the primary chamber by way of said restricted orifice to form a secondary headspace in the secondary chamber whereby the pressures in both the primary and secondary chambers are at equilibrium and gaseous pressures in both the primary and secondary headspaces are at a pressure greater than atmospheric so that, when the container is broached to open the primary headspace to atmospheric pressure, the pressure differential caused by the decrease in pressure at the primary headspace causes at least one of the beverage and gas in the secondary chamber to be ejected into the beverage of the primary chamber by way of said restricted orifice and the said ejection causes gas to be evolved from solution in the beverage in the primary chamber to form, or assist in the formation of, a head of froth on the beverage.

The present invention is applicable to a wide range of beverages of the type as previously discussed and where those beverages contain gas in solution which gas is intended to be liberated to form or assist in the formation of the head or froth on the beverage. Understandably the gas in solution must not detract from, and should preferably enhance the characteristics required of the beverage and be acceptable for use with food products; preferably therefore the gas is at least one of carbon dioxide and inert gases (by which latter term is included nitrogen) although it is to be realised that other gases may be appropriate.

The present invention was primarily developed for the packaging of fermented beverages such as beer, ale, stout, lager and cider where among the desirable qualities sought in a head are a consistent and regular, relatively fine, bubble size; a bubble structure which is substantially homogeneous so that the head is not formed with large irregularly shaped and random gaps; the ability for the head or bubble structure to endure during a reasonable period over which it is likely to be consumed, and a so-called "mouth-feel" and flavour which may improve the enjoyment of the beverage during consumption and not detract from the desirable flavour characteristics required of the beverage. These desirable qualities are of course equally applicable to non-fermented beverages, for example with so-called soft drinks. Conventionally, beverages of the type to which the invention relates are packaged in a non-resealable container which when opened totally vents the headspace to atmosphere, contain carbon dioxide in solution and it is the liberation of the carbon dioxide on opening of the package and dispensing of the beverage into a drinking vessel which creates the froth or head; however, the head so formed has very few of the aforementioned desirable qualities—in particular it is usually irregular, lacks homogeneity and has very little endurance so that there is a tendency for it to collapse after a short period. It has been known for approximately 25 years and as discussed in our G.B. Pat. No. 876,628, that beverages having in solution a mixture of carbon dioxide gas and inert gas (such as nitrogen or argon) will, when dispensed in a manner whereby the mixed gases are caused to evolve to develop the head or foam from small bubbles containing the mixture of carbon dioxide and, say, nitrogen gases, provide the desirable qualities for the head as previously discussed. Commercially the formation of the head by the use of mixed gases as aforementioned has been widely employed in the dispensing of beverage in a draught system and on demand from a bulk container (such as a keg or barrel) where the gases are caused to evolve by subjecting the beverage to intense shear forces in passing it under pressure through a set of small holes. Beverages, particularly stout, having a mixture of carbon dioxide and nitrogen gases in solution and dispensed in draught using the aforementioned technique have met with considerable commercial success and it was soon realised that there was a need to make available for consumption a similar beverage derived from a small non-resealable container suitable for shelf storage and retail purposes.

Research has indicated that to achieve the initiation of a head on a beverage containing carbon dioxide and inert gas such as nitrogen in solution it is necessary to provide so-called "active sites" which are regions where the beverage is subjected to a high local strain (such a strain being higher than the cohesive force of the beverage). In these conditions the beverage prefers to generate a bubble of mixed gases instead of "bending around" the active site. It was found that an active site could be solid, liquid or gas such as granules, restrictor holes, rapid streams of liquid or bubbles and the like. It was also found that ultrasonics could produce a "ghost" active site by the formation of extreme pressure gradients. There has however been a problem in providing an "active site" in a beverage packaged in a non-resealable small container in a manner which is commercially and economically acceptable. During the past 25 years considerable expenditure has been devoted to research and development in an attempt to overcome the aforementioned problem. For example, our G.B. Pat. No. 1,588,624 proposes initiating the evolution of mixed carbon dioxide and nitrogen gases from a beverage by subjecting the beverage to ultrasonic excitement, by injecting a gas, liquid and/or foam into the beverage by use of a syringe-type device, or by pouring the beverage over an excitation surface such as polystyrene granules. Although these latter proposals were successful in achieving the desired head formation, the necessity to use ancilliary apparatus had commercial disadvantages (for example, it is unreasonable to expect a retail customer to have available an ultrasonic signal generator; also the steps required to effect initiation of the head following opening of the beverage package involved an inconvenient discipline and time factor). In a further example our G.B. Pat. No. 1,266,351 relates to a non-resealable package containing beverage having mixed carbon dioxide and inert gases in solution; in this disclosure a can or bottle has two chambers of which a larger chamber contains the beverage while the smaller chamber is charged under pressure with the mixed gases. On opening of the can or bottle to expose the larger chamber to atmosphere, its internal pressure falls to atmospheric permitting the pressurised gas in the small chamber to jet into the beverage by way of a small orifice between the two chambers. This jet of gas provides sufficient energy to initiate the formation of minute bubbles and thereby the head from the evolution of the mixed gases in the beverage coming out of solution. By this proposal the small gas chamber is initially pressurised with the mixed gases to a pressure greater than atmospheric and from a source remote from the beverage; as a consequence it was found necessary, particularly in the case of cans, to provide a special design of two chambered container and an appropriate means for sealing the smaller chamber following the charging of that chamber with the mixed gases (such charging usually being effected, in the case of cans, by injecting the mixed gases into the small chamber through a wall of the can which then had to be sealed). Because of the inconvenience and high costs involved in the development of an appropriate two chambered container and the special facilities required for charging the mixed gases and sealing the container, the proposal proved commercially unacceptable.

The container employed in the present invention will usually be in the form of a can, bottle or carton capable of withstanding the internal pressures of the primary and secondary chambers and of a size suitable for conventional shelf storage by the retail trade so that, the overall volume of the container may be, typically, 0.5 liters but is unlikely to be greater than 3 liters.

By the present invention a two chambered container is employed as broadly proposed in G.B. Pat. No. 1,266,351; however, unlike the prior proposal the secondary chamber is partly filled with beverage containing gases in solution and the beverage in the secondary chamber is derived wholly from the beverage in the primary chamber so that when the contents of the primary and secondary chambers are in equilibrium (and the primary and secondary headspaces are at a pressure greater than atmospheric) immediately prior to broaching the container to open the primary headspace to atmosphere, the pressure differential between that in the secondary headspace and atmospheric pressure causes beverage in the secondary chamber to be ejected by way of the restricted orifice into the beverage in the primary chamber to promote the formation of the head of froth without the necessity of any external influence being applied to the package. The pressurisation of the headspace gas in the secondary chamber is intended to result from the evolution of gas in the sealed container as the contents of the container come into equilibrium at ambient or dispensing temperature (which should be greater than the temperature at which the container is charged and sealed). Consequently the present invention alleviates the necessity for pressurising the secondary chamber from a source externally of the container so that the secondary chamber can be formed as a simple envelope or hollow pod of any convenient shape (such as cylindrical or spherical) which is located as a discrete insert within a conventional form of can, bottle or carton (thereby alleviating the requirement for a special structure of can or bottle as envisaged in G.B. Pat. No. 1,266,351).

Although the head or froth formed by pouring wholly carbonated beverages tends to lack many of the desirable qualities required of a head as previously discussed; our tests have indicated that by use of the present invention with wholly carbonated beverages (where the head is formed by injection of beverage from the secondary chamber into the primary chamber) the resultant head is considerably tighter or denser than that achieved solely by pouring and as such will normally have a greater life expectancy.

The beverage is preferably saturated or supersaturated with the gas (especially if mixed carbon dioxide and inert gases are employed) and the primary chamber charged with the beverage under a counterpressure and at a low temperature (to alleviate gas losses and, say, at a slightly higher temperature than that at which the beverage freezes) so that when the container is sealed (which may be achieved under atmospheric pressure using conventional systems such as a canning or bottling line), the pressurisation of the primary and secondary headspaces is achieved by the evolution of gas from the beverage within the primary and secondary chambers as the package is handled or stored at an ambient or dispensing temperature (greater than the charging temperature) and the contents of the container adopt a state of equilibrium. Following the sealing of the container, the package may be subjected to a heating and cooling cycle, conveniently during pasteurisation of the beverage.

The restricted orifice through which the primary and secondary chambers communicate is conveniently formed by a single aperture in a side wall of the secondary chamber and such an aperture should have a size which is sufficiently great to alleviate "clogging" or its obturation by particles which may normally be expected to occur within the beverage and yet be restricted in its dimensions to ensure that there is an adequate jetting effect in the ejection of the beverage therethrough from the secondary chamber into the primary chamber to promote the head formation upon opening of the container. The restricted orifice may be of any profile (such as a slit or a star shape) but will usually be circular; experiments have indicated that a restricted orifice having a diameter in the range of 0.02 to 0.25 centimeters is likely to be appropriate for fermented beverages (the preferred diameter being 0.061 centimeters). It is also preferred that when the package is positioned in an upstanding condition in which it is likely to be transported, shelf stored or opened, the restricted orifice is located in an upwardly extending side wall or in a bottom wall of the secondary chamber and preferably at a position slightly spaced from the bottom of the primary chamber. When the contents of the sealed package are in equilibrium and the package is in an upstanding condition as aforementioned, the restricted orifice is located below the depth of the beverage in the secondary chamber so that on opening of the container the pressure of gas in the secondary headspace initially ejects beverage from that chamber into the beverage in the primary chamber to promote the head formation. Such ejection of beverage through the restricted orifice provides a greater efficiency in the development of the head in a liquid supersaturated with gas than will the ejection of gas alone through the restricted orifice; the reason for this is that the restricted orifice provides a very active site which causes the beverage to "rip itself apart" generating extremely minute bubbles which themselves act as active sites for the beverage in the primary chamber, these extremely minute bubbles leave "vapour trails" of larger initiated bubbles which in turn produce the head. Since the extremely minute bubbles are travelling at relatively high speed during their injection into the beverage in the primary chamber, they not only generate shear forces on the beverage in that chamber but the effect of each such bubble is distributed over a volume of beverage much larger than the immediate surroundings of an otherwise stationary bubble.

A particular advantage of the present invention is that prior to the container being charged with beverage both the primary and secondary chambers can be at atmospheric pressure and indeed may contain air. However, it is recognized that for many beverages, particularly a fermented beverage, prolonged storage of the beverage in contact with air, especially oxygen, is undesirable as adversely affecting the characteristics of the beverage. To alleviate this possibility the secondary chamber may initially be filled with a "non-contaminant" gas such as nitrogen (or other inert gas or carbon dioxide) which does not adversely affect the characteristics of the beverage during prolonged contact therewith. The secondary chamber may be filled with the non-contaminant gas at atmospheric pressure or slightly greater (to alleviate the inadvertent intake of air) so that when the container is charged with the beverage, the non-contaminant gas will form part of the pressurised headspace in the secondary chamber. As previously mentioned, the secondary chamber may be formed by an envelope or hollow pod which is located as a discrete insert within a conventional form of can, bottle or carton and such a discrete insert permits the secondary chamber to be filled with the non-contaminant gas prior to the envelope or pod being located within the can, bottle or carton. A convenient means of achieving this latter effect is by blow moulding the envelope or pod in a food grade plastics material using the non-contaminant gas as the blowing medium and thereafter sealing the envelope or pod to retain the non-contaminant gas therein; immediately prior to the pod or envelope being inserted into the can, bottle or carton, the restricted orifice can be formed in a side wall of the pod or envelope (for example by laser boring). Immediately prior to the container being sealed it is also preferable to remove air from the primary headspace and this may be achieved using conventional techniques such as filling the headspace with froth or fob developed from a source remote from the container and having characteristics similar to those of the head which is to be formed from the beverage in the container; charging the primary chamber with the beverage in a nitrogen or other inert gas atmosphere so that the headspace is filled with that inert gas or nitrogen; dosing the headspace with liquid nitrogen so that the gas evolved therefrom expels the air from the headspace, or by use of undercover gassing or water jetting techniques to exclude air.

The secondary chamber may be charged with beverage from the primary chamber at ambient temperature. It is possible to ensure that the secondary chamber is efficiently charged by applying an auxilliary pressure to the headspace of the primary chamber (relative to the headspace in the secondary chamber) and allowing the pressures in the container to equilibriate after the primary chamber has been sealed. An efficient means of applying an auxiliary pressure is by use of the aforementioned liquid nitrogen dosing where a dose of liquid nitrogen is applied to the headspace of the beverage in the primary chamber immediately before that chamber is sealed so that, following sealing, the development of pressure in the primary headspace (assisted by the evolution of nitrogen gas from the dosing) forces beverage from the primary chamber into the secondary chamber (by way of the restricted orifice) until a state of equilibrium is reached for the contents of the container.

Although the secondary chamber may be constructed as an integral part of the container, for the reasons discussed above and also convenience of manufacture, it is preferred that the secondary chamber is formed as a discrete insert which is simply deposited or pushed into a conventional form of can, bottle or carton. With cans or cartons such an insert will not be visible to the end user and many bottled beverages are traditionally marketed in dark coloured glass or plastics so that the insert is unlikely to adversely affect the aesthetics of the package. The discrete insert may be suspended or float in the beverage in the primary chamber provided that the restricted orifice is maintained below the surface of the beverage in the primary chamber on opening of the container; for example the insert may be loaded or weighted to appropriately orientate the position of the restricted orifice. Desirably however the insert is restrained from displacement within the outer container of the package and may be retained in position, for example at the bottom of the outer container, by an appropriate adhesive or by mechanical means such as projections on the package which may flex to abut and grip a side wall of the outer container or which may engage beneath an internal abutment on the side wall of the outer container.

DRAWINGS

One embodiment of the present invention as applied to the packaging of a fermented beverage such as stout in a can will now be described, by way of example only, with reference to the accompanying illustrative drawings, in which:

FIGS. 1 to 4 diagrammatically illustrate the progressive stages in the formation of the beverage package in a canning line, and FIG. 5 diagrammatically illustrates the effect on opening the beverage package prior to consumption of the beverage and the development of the head of froth on the beverage.

DETAILED DESCRIPTION OF DRAWINGS

The present embodiment will be considered in relation to the preparation of a sealed can containing stout having in solution a mixture of nitrogen and carbon dioxide gases, the former preferably being present to the extent of at least 1.5% vols/vol and typically in the range 1.5% to 3.5% vols/vol and the carbon dioxide being present at a considerably lower level than the amount of carbon dioxide which would normally be present in conventional, wholly carbonated, bottled or canned stout and typically in the range 0.8 to 1.8 vols/vol (1.46 to 3.29 grams/liter). For the avoidance of doubt, a definition of the term "vols/vol" is to be found in U.S. Pat. No. 4,279,938 and may be taken as "the number of volumes of gas which are dissolved in a unit volume of the beverage, said volumes of gas being determined at a pressure of 760 millimeters of mercury and at a temperature of 15.6° C.".

Figure 1:
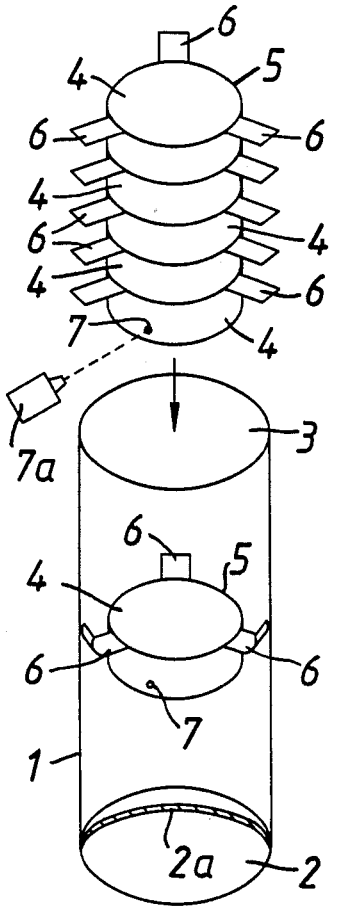

The stout is to be packaged in a conventional form of cylindrical can (typically of aluminum alloy) which, in the present example, will be regarded as having a capacity of 500 milliliters and by use of a conventional form of filling and canning line appropriately modified as will hereinafter be described. A cylindrical shell for the can 1 having a sealed base 2 and an open top 3 is passed in an upstanding condition along the line to a station shown in FIG. 1 to present its open top beneath a stack of hollow pods 4. Each pod 4 is moulded in a food grade plastics material such as polypropylene to have a short (say 5 millimeters) hollow cylindrical housing part 5 and a circumferentially spaced array of radially outwardly extending flexible tabs or lugs 6. The pods 4 are placed in the stack with the chamber formed by the housing part 5 sealed and containing nitrogen gas at atmospheric pressure (or at pressure slightly above atmospheric); conveniently this is achieved by blow moulding the housing part 5 using nitrogen gas. The volume within the housing part 5 is approximately 15 milliliters. At the station shown in FIG. 1 the bottom pod 4 of the stack is displaced by suitable means (not shown) into the open topped can 1 as shown. However, immediately prior to the pod 4 being moved into the can 1 a small (restricted) hole 7 is bored in the cylindrical side wall of the housing part 5. In the present example, the hole 7 has a diameter in the order of 0.61 millimeters and is conveniently bored by a laser beam generated by device **7*a* (although the hole could be formed by punching or drilling). The hole 7 is located towards the bottom of the cylindrical chamber within the housing part 5. Since the hollow pod 4 contains nitrogen gas at atmospheric pressure (or slightly higher) it is unlikely that air will enter the hollow pod through the hole 7 during the period between boring the hole 7 and charging of the can 1 with stout (thereby alleviating contamination of the stout by an oxygen content within the hollow pod 4**).

The hollow pod 4 is pressed into the can 1 to be seated on the base 2. Conventional cans 1 have a domed base 2 (shown by the section **2*a*) which presents a convex internal face so that when the pod 4 abuts this face a clearance is provided between the hole 7 and the underlying bottom of the chamber within the can 1. It will be seen from FIG. 1 that the diameter of the housing part 5 of the pod 4 is less than the internal diameter of the can 1 while the diameter of the outermost edges of the lugs 6 is greater than the diameter of the can 1 so that as the pod 4 is pressed downwardly into the can, the lugs 6 abut the side wall of the can and flex upwardly as shown to grip the can side wall and thereby restrain the hollow pod from displacement away from the base 2**.

Figure 2:
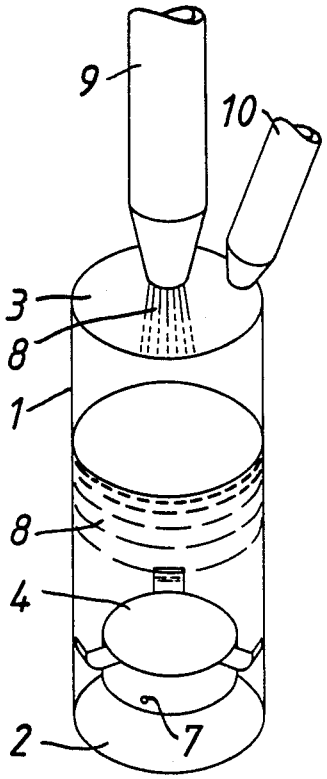

The open topped can with its pod 4 is now displaced along the canning line to the station shown in FIG. 2 where the can is charged with approximately 440 milliliters of stout 8 from an appropriate source 9. The stout 8 is supersaturated with the mixed carbon dioxide and nitrogen gases, typically the carbon dioxide gas being present at 1.5 vols/vol (2.74 grams/liter) and the nitrogen gas being present at 2% vols/vol. The charging of the can 1 with the stout may be achieved in conventional manner, that is under a counterpressure and at a temperature of approximately 0° C. When the can 1 is charged with the appropriate quantity of stout 8, the headspace above the stout is purged of air, for example by use of liquid nitrogen dosing or with nitrogen gas delivered by means indicated at 10 to alleviate contamination of the stout from oxygen in the headspace.

Figure 3:
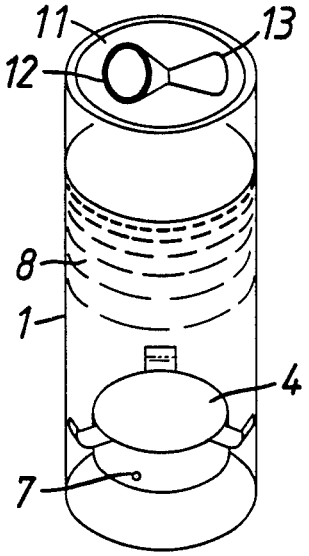

Following charging of the can 1 with stout and purging of the headspace, the can moves to the station shown in FIG. 3 where it is closed and sealed under atmospheric pressure and in conventional manner by a lid 11 seamed to the cylindrical side wall of the can. The lid 11 has a pull-ring 12 attached to a weakened tear-out region 13 by which the can is intended to be broached in conventional manner for dispensing of the contents.

Following sealing, the packaged stout is subjected to a pasteurisation process whereby the package is heated to approximately 60° C. for about 15–20 minutes and is thereafter cooled to ambient temperature. Stout flows from the chamber of the can into the chamber of the pod so that when the package is at ambient temperature the hole 7 is located below the depth of stout 8*a* within the hollow pod 4.

Following the pasteurisation process the contents of the can 1 will stabilise in a condition of equilibrium with a headspace 1*a* over the stout 8 in the primary chamber of the can and a headspace 4*a* over the stout 8*a* in the secondary chamber forced by the hollow pod 4 and in the equilibrium condition. With the sealed can at ambient temperature (or a typical storage or dispensing temperature which may be, say, 8° C.) the pressure of mixed gases carbon dioxide and nitrogen (which largely results from the evolution of such gases from the stout) is substantially the same in the headspaces 1*a* and 4*a* and this pressure will be greater than atmospheric pressure, typically in the order of 25lbs per square inch (1.72 bars).

Figure 4:
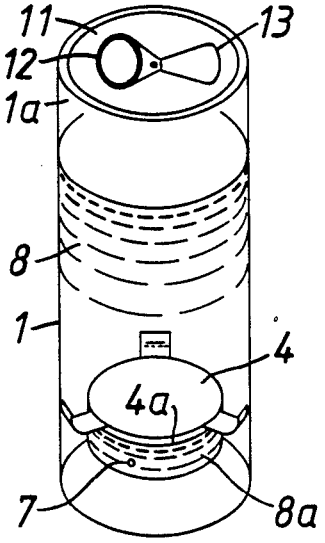
Figure 5:
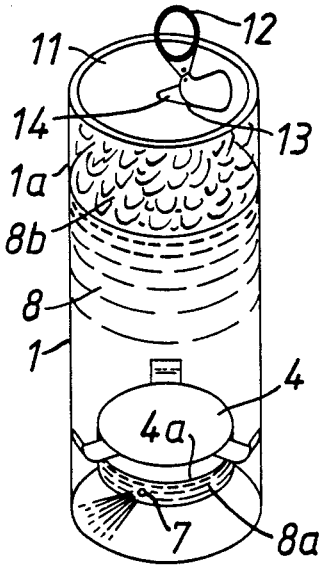

The package in the condition shown in FIG. 4 is typically that which would be made available for storage and retail purposes. During handling it is realised that the package may be tipped from its upright condition; in practice however this is unlikely to adversely affect the contents of the hollow pod 4 because of the condition of equilibrium within the can.

When the stout is to be made available for consumption, the can 1 is opened by ripping out the region 13 with the pull-ring 12. On broaching the lid 11 as indicated at 14 the headspace 1*a* rapidly depressurises to atmospheric pressure. As a consequence the pressure within the headspace 4*a* of the secondary chamber in the pod 4 exceeds that in the headspace 1*a* and causes stout 8*a* in the hollow pod to be ejected by way of the hole 7 into the stout 8 in the primary chamber of the can. The restrictor hole 7 acts as a very "active site" to the supersaturated stout 8*a* which passes therethrough to be injected into the stout 8 and that stout is effectively "ripped apart" to generate extremely minute bubbles which themselves act as active sites for the stout 8 into which they are injected. These minute bubbles leave "vapour trails" of larger initiated bubbles which develop within the headspace 1*a* a head 8*b* having the previously discussed desirable characteristics.

It is appreciated that the headspace 1*a* occupies a larger proportion of the volume of the can 1 than that which would normally be expected in a 500 milliliter capacity can; the reason for this is to ensure that there is adequate volume in the headspace 1*a* for the head of froth 8*b* to develop efficiently in the event, for example, that the stout is to be consumed directly from the can when the tear-out region 13 is removed. Normally however the stout 8 will first be poured from the can into an open topped drinking vessel prior to consumption but this pouring should not adversely affect the desirable characteristics of the head of froth which will eventually be presented in the drinking vessel.

In the aforegoing embodiment the can 1 is charged with stout 8 (from the source 9) having in solution the required respective volumes of the carbon dioxide and the nitrogen gases. In a modification the can 1 is charged with stout (from source 9) having the carbon dioxide gas only in solution to the required volume; the 2% vols/vol nitrogen gas necessary to achieve the required solution of mixed gas in the packaged stout is derived from the liquid nitrogen dosing of the headspace in the can.

We claim:

1. A beverage package comprising a sealed, non-resealable, container having a primary chamber containing beverage having gas in solution therewith and forming a primary headspace comprising gas at a pressure greater than atmospheric; enclosure means defining a secondary chamber having a volume less than said primary chamber; restrictor means defining a restricted orifice, said secondary chamber communicating with the beverage in said primary chamber through said restricted orifice; said secondary chamber containing beverage supplied thereto from the beverage in the primary chamber and having a secondary headspace therein comprising gas at a pressure greater than atmospheric so that the pressures within the primary and secondary chambers are substantially at equilibrium; said container is openable to expose the primary headspace to atmospheric pressure, and wherein the secondary chamber is arranged so that upon opening of the container the pressure differential caused by the decrease in pressure at the primary headspace causes beverage in the secondary chamber to be ejected by way of the restricted orifice into the beverage of the primary chamber and said ejection causes gas in the solution to be evolved and form, or assist in the formation of, a head of froth on the beverage.

2. A package as claimed in claim 1 in which the container has a base and is upstanding from said base and has an openable top, and said enclosure means has an upwardly extending side wall or a bottom wall within which said restricted orifice is located.

3. A package as claimed in claim 1 in which the container has a base on which the enclosure means is located and said restricted orifice is located in an upwardly extending side wall of the enclosure means spaced from said base.

4. A package as claimed in claim 1 in which the restricted orifice comprises a circular aperture having a diameter in the range of 0.02 to 0.25 centimeters.

5. A package as claimed in claim 1, wherein said gas-containing beverage is a fermented beverage having in solution therewith carbon dioxide in the range 0.8% to 1.8% vols/vol and nitrogen in the range 1.5% to 3.5% vols/vol.

6. A package as claimed in claim 1 in which the beverage has in solution therewith at least one of carbon dioxide and nitrogen gas.

7. A package as claimed in claim 6 in which the beverage is supersaturated with said gases.

8. A package as claimed in claim 1 wherein the enclosure means comprises a hollow component inserted in the container.

9. A package as claimed in claim 8 wherein the hollow component comprises a hollow moulding.

10. A package as claimed in claim 8 in which the enclosure means floats or is suspended in the beverage in the primary chamber and means is provided for locating the restricted orifice below the surface of the beverage in the primary chamber.

11. A package as claimed in claim 10 wherein said locating means comprises a load means connected with the enclosure means and weighted to locate the restricted orifice below the surface of the beverage in the primary chamber.

12. A package as claimed in claim 8 wherein means is provided for retaining the enclosure means at a predetermined position within the container.

13. A package as claimed in claim 12 wherein the container has a base and is upstanding from said base and has an openable top and said enclosure means is located at or towards the base of said container.

14. A package as claimed in claim 12 wherein the enclosure means comprises a hollow envelope having means thereon for retaining it within the container.

15. A package as claimed in claim 14 wherein the retaining means comprise flexible tab means which engage a side wall of the container to retain the insert.

16. A package as claimed in claim 14 in which the hollow envelope comprises a hollow moulding and in which the container has a side wall and the moulding is substantially cylindrical with radially extending tabs engaging the side wall of the container.

17. A method of packaging a beverage having gas in solution therewith which comprises providing a container with a primary chamber and a secondary chamber of which the volume of the secondary chamber is less than that of the primary chamber and with the means defining a restricted orifice through which the secondary chamber communicates with the primary chamber, and charging and sealing the primary chamber with the beverage to contain the gas in solution and to form a primary headspace in the primary chamber, and charging the secondary chamber with beverage supplied thereto from the primary chamber by way of said restricted orifice to form a secondary headspace in the secondary chamber whereby the pressures in both the primary and secondary chambers are at equilibrium and gaseous pressures in both the primary and secondary headspaces are at a pressure greater than atmospheric so that, when the container is broached to open the primary headspace to atmospheric pressure, the pressure differential caused by the decrease in pressure at the primary headspace causes beverage in the secondary chamber to be ejected into the beverage of the secondary chamber by way of said restricted orifice and the said ejection causes gas to be evolved from solution in the beverage in the primary chamber to form, or assist in the formation of, a head of froth on the beverage.

18. A method as claimed in claim 17 which comprises, prior to sealing the primary chamber, purging the primary head space to exclude air.

19. A method as claimed in claim 17 in which the container has a base and is upstanding from said base and has an openable top, and said secondary chamber has an upwardly extending side wall or a bottom wall within which said restricted orifice is located.

20. A method as claimed in claim 17 which comprises subjecting the sealed container to a heating and cooling cycle.

21. A method as claimed in claim 20 in which the heating and cooling cycle comprises heating to pasteurization temperatures of the beverage.

22. A method as claimed in claim 17 in which comprises applying an auxiliary gas pressure to the headspace of the primary chamber and allowing the pressures within the container to equilibriate when the primary chamber is sealed.

23. A method as claimed in claim 22 which further comprises applying the auxiliary gas pressure to the headspace of the primary chamber as a result of liquid nitrogen dosing prior to the primary chamber being sealed.

24. A method as claimed in claim 17 in which the gas comprises at least one of carbon dioxide and nitrogen gas.

25. A method as claimed in claim 24 in which the beverage is fermented and has in solution carbon dioxide in the range 0.8% to 1.8% vols/vol and nitrogen in the range 1.5% to 3.5% vols/vol.

26. A method a claimed in claim 17 which further comprises defining the secondary chamber by discrete hollow enclosure means and locating said enclosure means within the primary chamber of the container.

27. A method as claimed in claim 26 in which the enclosure means is floated or suspended in the beverage in the primary chamber and which further comprises loading or weighting the enclosure means to locate the restricted orifice below the surface of the beverage in the primary chamber.

28. A method as claimed in claim 26 which further comprises retaining the enclosure means at a predetermined position within the container.

29. A method as claimed in claim 26 which further comprises forming the restricted orifice in the enclosure means by the method selected from the group consisting of laser boring, drilling and punching.

30. A method as claimed in claim 26 in which the container prior to being sealed has a base and is upstanding from said base and has an open top through which the primary chamber is charged with said beverage and which further comprises locating the enclosure means through said open top to provide the secondary chamber within the container.

31. A method as claimed in claim 26 which further comprises forming the hollow enclosure means having the restricted orifice in a wall thereof and locating the enclosure means within the primary chamber prior to the charging and sealing of the primary chamber.

32. A method as claimed in claim 31 which further comprises press fitting the enclosure means within the container through an open top thereof so that during its location the enclosure means engages with a side wall of the container to be retained in position.

33. A method as claimed in claim 26 which further comprises forming the enclosure means by blow moulding.

34. A method as claimed in claim 33 which further comprises blow moulding the enclosure means with gas for dissolution in the beverage so that said gas is sealed within the secondary chamber, and forming said restricted orifice in the wall of the enclosure means immediately prior to locating the enclosure means in the primary chamber.

35. A method as claimed in claim 34 which further comprises sealing said gas in the secondary chamber at least at atmospheric pressure.

* * * * *

UNITED STATES PATENT AND TRADEMARK OFFICE

CERTIFICATE OF CORRECTION

PATENT NO. : 4,832,968

DATED : May 23, 1989

INVENTOR(S) : Alan J. Forage, et al

It is certified that error appears in the above-identified patent and that said Letters Patent is hereby corrected as shown below:

On the title page item [73] should read --Arthur Guinness Son & Company (Dublin) Limited--

Signed and Sealed this

Twenty-sixth Day of February, 1991

*Attest:*

HARRY F. MANBECK, JR.

*Attesting Officer*

*Commissioner of Patents and Trademarks*